US011098507B2

(12) United States Patent
Edwards et al.

(10) Patent No.: US 11,098,507 B2
(45) Date of Patent: Aug. 24, 2021

(54) DOOR HANDLE ASSEMBLY WITH RETENTION FEATURE

(71) Applicant: GM Global Technology Operations LLC, Detroit, MI (US)

(72) Inventors: Robert Jerry Edwards, Lapeer, MI (US); Carolyn J. Thor, Lake Orion, MI (US); Steven J. Briggs, Harrison Township, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 586 days.

(21) Appl. No.: 15/992,769

(22) Filed: May 30, 2018

(65) Prior Publication Data

US 2019/0368241 A1 Dec. 5, 2019

(51) Int. Cl.
*E05B 85/16* (2014.01)
*E05B 79/06* (2014.01)

(52) U.S. Cl.
CPC ..... *E05B 85/16* (2013.01); *E05B 79/06* (2013.01)

(58) Field of Classification Search
CPC ..... E05B 79/06; E05B 85/16
See application file for complete search history.

(56) References Cited

U.S. PATENT DOCUMENTS

2006/0038417 A1* 2/2006 Pudney ..... E05B 13/002 292/336.3
2011/0042973 A1* 2/2011 Yoshino ..... E05B 79/06 292/336.3
2013/0161964 A1* 6/2013 Ishida ..... E05B 83/40 292/336.3

* cited by examiner

*Primary Examiner* — Kristina R Fulton
*Assistant Examiner* — James Edward Ignaczewski

(57) ABSTRACT

A door handle assembly includes a bracket having a retention feature, an end cap connected to the bracket, and a handle pivotally connected to the bracket and moveable between a closed position and an open position, the handle having a pivot arm disposed within the bracket, the pivot arm having a pivot point and a lower portion, wherein the pivot arm engages the bracket and the lower portion is disposed on a side of the pivot point opposite the handle. The retention feature engages the lower portion when the handle is in the closed position and applies a force on the pivot arm in a rearward direction to maintain a gap distance between the handle and the end cap.

13 Claims, 4 Drawing Sheets

DOOR HANDLE ASSEMBLY WITH RETENTION FEATURE

INTRODUCTION

The present disclosure relates to a door handle assembly with a retention feature for the handle, and more particularly to a door handle assembly on a motor vehicle with a retention feature for the handle that maintains a gap consistency between the handle and an end cap.

Motor vehicles generally include a door handle assembly mounted to an exterior of the motor vehicle door panel to allow easy access to the motor vehicle compartment. Typically, an end cap and a handle are on the exterior of the door handle assembly and are readily visible. The end cap is stationary relative to the door panel and may contain a door lock or other mechanism. The handle pivots with respect to the end cap when opened. A gap exists between the end cap and the door handle when the door handle is in the closed position. Due to stacking tolerances and movement of the door handle, this gap may be inconsistent and may negatively affect the aesthetic of the motor vehicle. Thus, while current door handle assemblies achieve their intended purpose, there is a need for a new and improved door handle assembly that maintains a consistent gap while not adversely affecting the operation and feel of the door handle.

SUMMARY

According to several aspects, a door handle assembly includes a bracket having a retention feature, an end cap connected to the bracket, and a handle pivotally connected to the bracket and moveable between a closed position and an open position, the handle having a pivot arm disposed within the bracket, the pivot arm having a pivot point and a lower portion, wherein the pivot arm engages the bracket and the lower portion is disposed on a side of the pivot point opposite the handle. The retention feature engages the lower portion when the handle is in the closed position and applies a force on the pivot arm in a rearward direction to maintain a gap distance between the handle and the end cap.

In one aspect, the retention feature is semi-flexible in a forward direction and the rearward direction.

In another aspect, the retention feature includes a lever extending into the bracket, the lever having a bent portion that extends toward the pivot arm.

In another aspect, the retention feature includes a curved surface on the lever that engages a matching curved surface on the lower portion of the pivot arm.

In another aspect, the retention feature does not engage the pivot arm when the pivot arm has rotated approximately 3 degrees from the closed position.

In another aspect, the handle includes a forward portion and a rearward portion, and the pivot arm is disposed at the forward portion of the handle.

In another aspect, the end cap is disposed adjacent the rearward portion of the handle.

In another aspect, the rearward portion of the handle is connected to the bracket by a leg.

In another aspect, a spring is connected to the leg, wherein the spring biases the handle to the closed position.

In another aspect, the bias of the spring exerts a force on the handle greater than the force on the pivot arm applied by the retention feature to keep the handle in the closed position when not moved to the open position by an operator of the door handle assembly.

In another aspect, the retention feature is integrally molded with the bracket.

In another aspect, the bracket defines a window through which the pivot arm of the handle is extended, and the retention feature is disposed adjacent the window.

In another aspect, the bracket includes an outer side on which the handle is disposed and an inner side through which the pivot arm of the handle extends.

According to several aspects of the present disclosure, a door handle assembly for a door of a motor vehicle includes a bracket connected to the door and having a retention feature, the retention feature having a lever extending from the bracket, the lever semi-flexible in a forward direction and a rearward direction, the lever having an engagement surface at an end thereof, an end cap connected to the bracket, and a handle pivotally connected to the bracket and moveable between a closed position and an open position, the handle having a pivot arm disposed within the bracket, the pivot arm having a pivot point and a lower portion, wherein the pivot arm engages the bracket and the lower portion is disposed on a side of the pivot point opposite the handle, and the lower portion has a contact surface matching a shape of the engagement surface of the lever. The engagement surface of the lever engages the contact surface of the lower portion when the handle is in the closed position and applies a force on the pivot arm in the rearward direction to maintain a gap distance between the handle and the end cap.

In one aspect, the engagement surface of the lever does not engage the contact surface of the lower portion when the handle is in the open position.

In another aspect, the bracket includes an inner side connected to the door and an outer side, the handle disposed on the outer side of the bracket, the pivot arm extending through a window in the bracket and the lever engaging the pivot arm on the inner side of the bracket.

In another aspect, the handle includes a forward portion and a rearward portion, and the pivot arm is disposed at the forward portion of the handle, and the end cap is disposed adjacent the rearward portion of the handle.

In another aspect, a spring biases the handle to the closed position and the bias of the spring exerts a force on the handle greater than the force on the pivot arm applied by the retention feature to keep the handle in the closed position when not moved to the open position by an operator of the door handle assembly.

According to several aspects of the present disclosure, a door handle assembly for a door of a motor vehicle includes a bracket connected to the door and having a retention feature, the retention feature having a lever extending from the bracket, the lever semi-flexible in a forward direction and a rearward direction, the lever having an engagement surface at an end thereof, an end cap connected to the bracket, and a handle pivotally connected to the bracket and moveable between a closed position and an open position, the handle having a pivot arm disposed within the bracket, the pivot arm having a pivot point and a lower portion, wherein the pivot arm engages the bracket at the pivot point and the handle pivots about the pivot point, the lower portion disposed on a side of the pivot point opposite the handle, and the lower portion having a contact surface matching a shape of the engagement surface of the lever. The engagement surface of the lever engages the contact surface of the lower portion when the handle is in the closed position and applies a force on the pivot arm in the rearward direction to maintain a gap distance between the handle and the end cap, and wherein the engagement surface of the lever does not engage the contact surface of the lower portion when the handle is in the open position.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
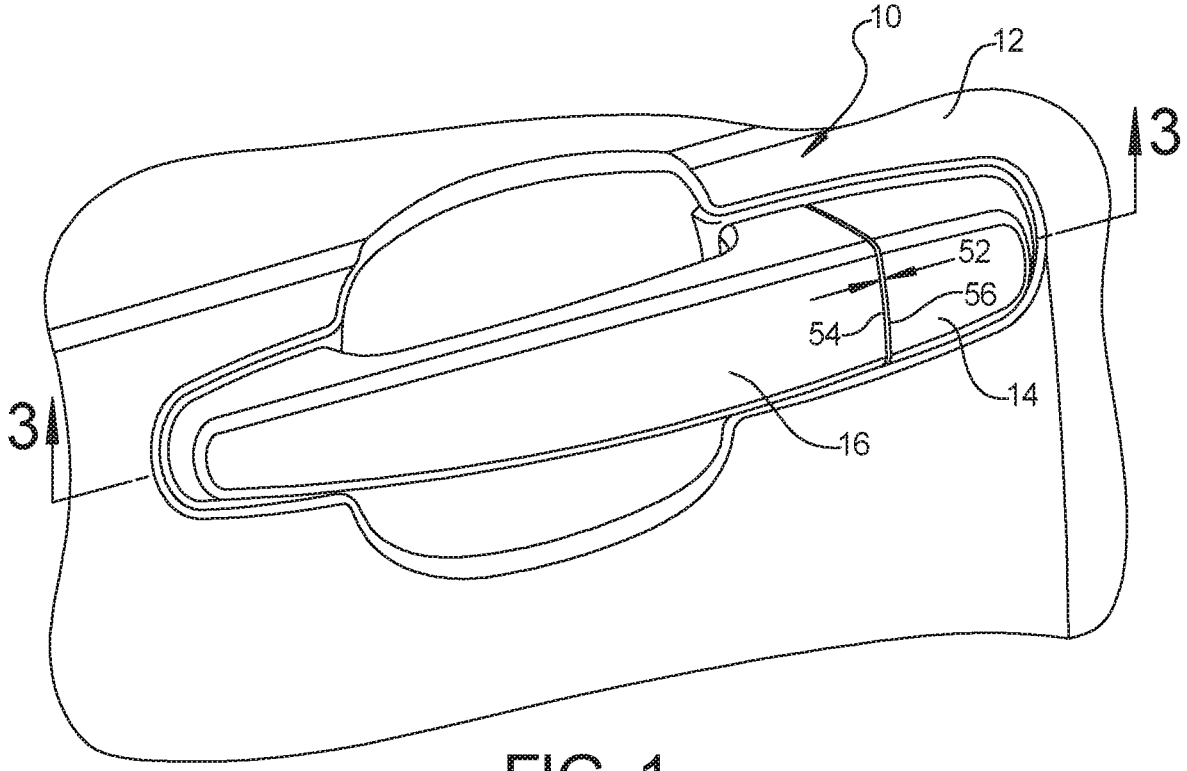
FIG. 1 is an outer perspective view of a door handle assembly in a closed position according to an exemplary embodiment.
Figure 2:
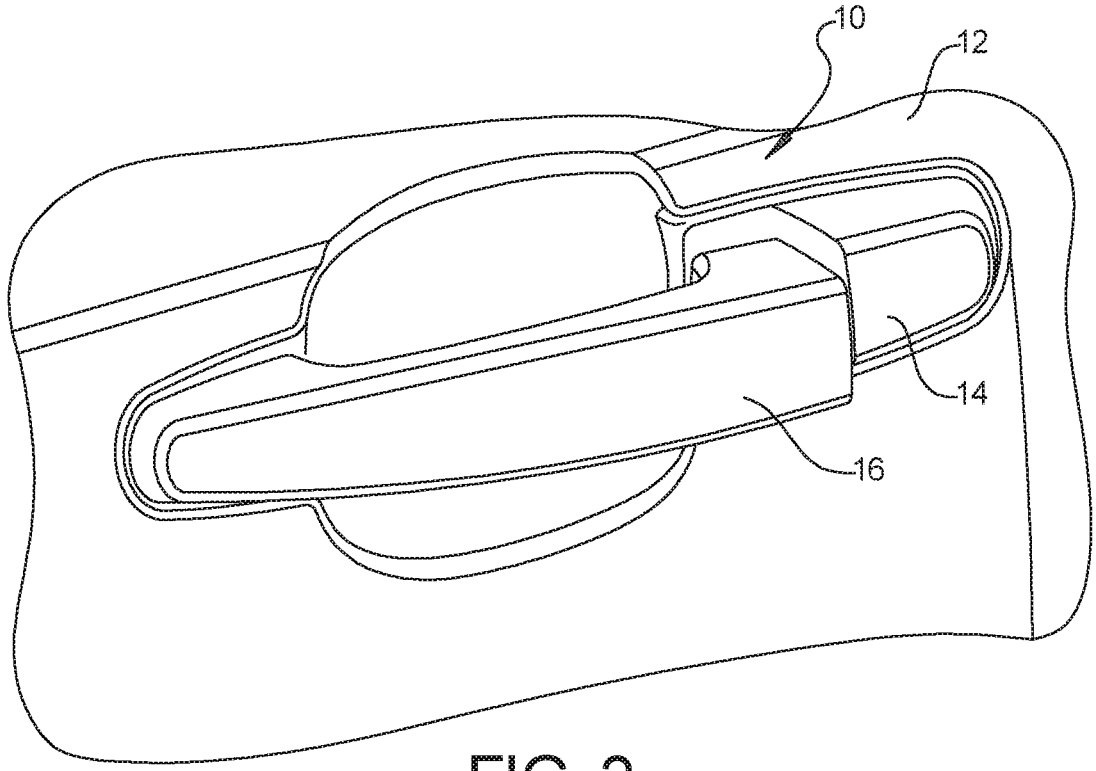
FIG. 2 is an outer perspective view of the door handle assembly in an open position according to an exemplary embodiment.
Figure 3:
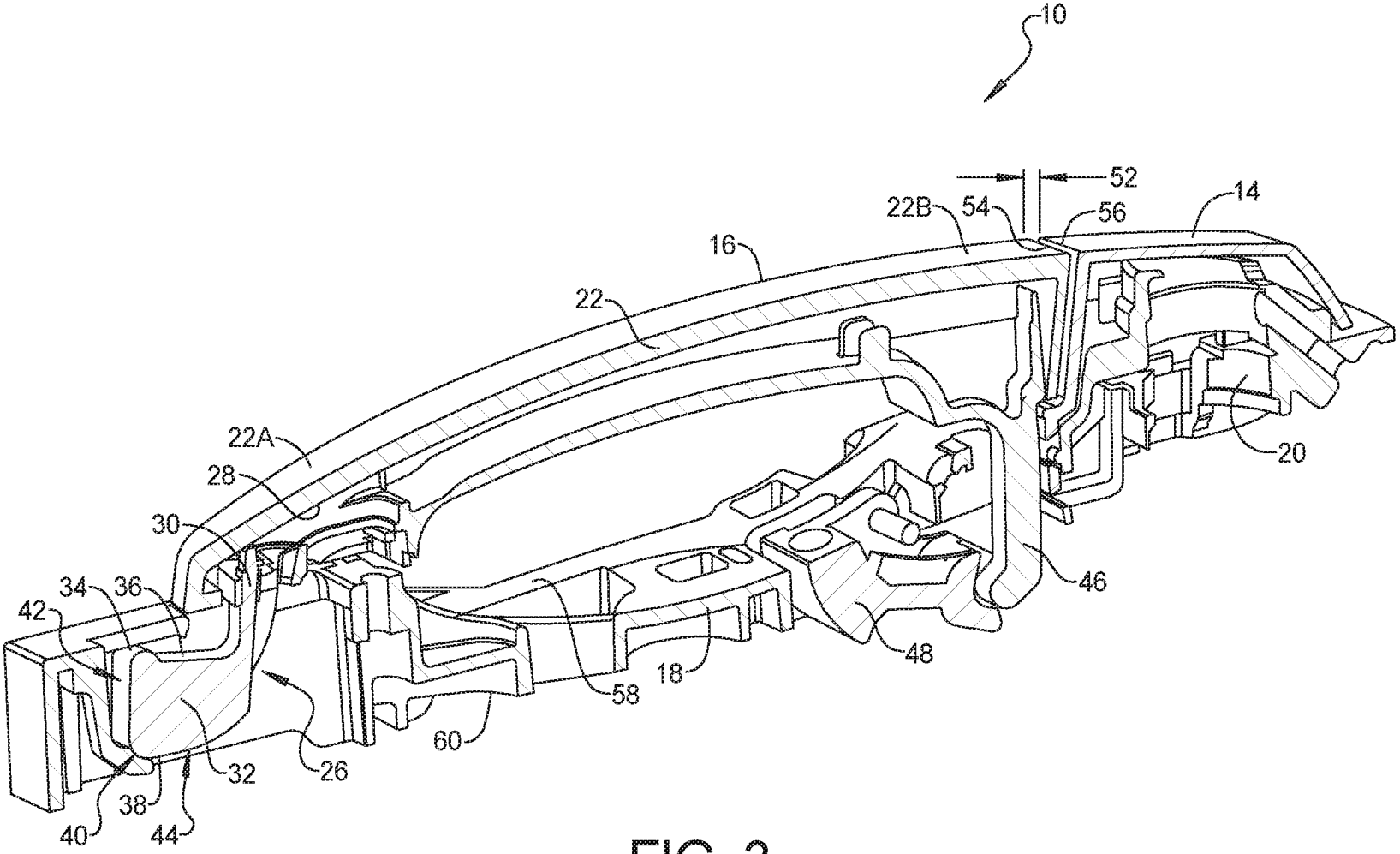
FIG. 3 is a cross-sectional perspective view of the door handle assembly viewed in the direction of arrows 3-3 in FIG. 1.

Referring to FIGS. 1-3, a door handle assembly is generally indicated by reference number 10. The door handle assembly 10 is shown mounted in an exemplary door panel 12 of a motor vehicle. The door panel 12 forms an exterior surface of the motor vehicle. The door panel 12 may be a driver's side door, passenger door, or any other door on the motor vehicle. The motor vehicle may be a passenger car, truck, sport utility vehicle, or any other vehicle that includes a door for accessing an interior of the vehicle such as a construction vehicle, aircraft, watercraft, etc. Generally, the door handle assembly 10 includes an end cap 14, a handle 16, and a bracket 18.

The end cap 14 is fixedly connected to the bracket 18 at a rearward end of the door handle assembly 10. In one aspect the end cap 14 houses a key lock/unlock mechanism (not shown) or an electronic push button lock/unlock device (not shown) that is mounted within a cylinder 20 formed in the bracket 18. In another aspect, the end cap 14 is decorative and improves the aesthetic of the door handle assembly 10.

The handle 16 is pivotally connected to the bracket 18, as will be described in greater detail below, and is moveable between a closed position, shown in FIG. 1, and an open position, shown in FIG. 2. The handle 16 is interconnected to a door latch/unlatch mechanism (not shown) such that when the handle is in the closed position the door is latched and when the handle is in the open position the door is unlatched. The handle 16 includes a handle body 22 intended to be gripped by a user of the door handle assembly 10. The handle body 22 includes forward portion 22A and a rearward portion 22B longitudinally opposite the forward portion 22.

A pivot arm 26 extends out from an inner side 28 of the handle 16 at the forward portion 22A. The pivot arm 26 includes a first section 30 that extends towards the bracket 18 and a second section 32 that extends in a forward direction. A pivot point 34 is formed on an outer surface 36 of the second section 32. The pivot point 34 is generally cylindrical in shape to provide point contact between the handle 16 and the bracket 18, as will be further described below. The second section 32 further includes a lower portion 38 that is disposed inwardly of the pivot point 34. Thus, the lower portion 38 and the handle body 22 are disposed on opposite sides of the pivot point 34. The lower portion 38 includes a contact surface 40 disposed between the transition of a forward surface 42 of the lower portion 38 and an inner surface 44 of the lower portion 38. The contact surface 40 is preferably curved with a substantially circular cross-section.

Figure 4:
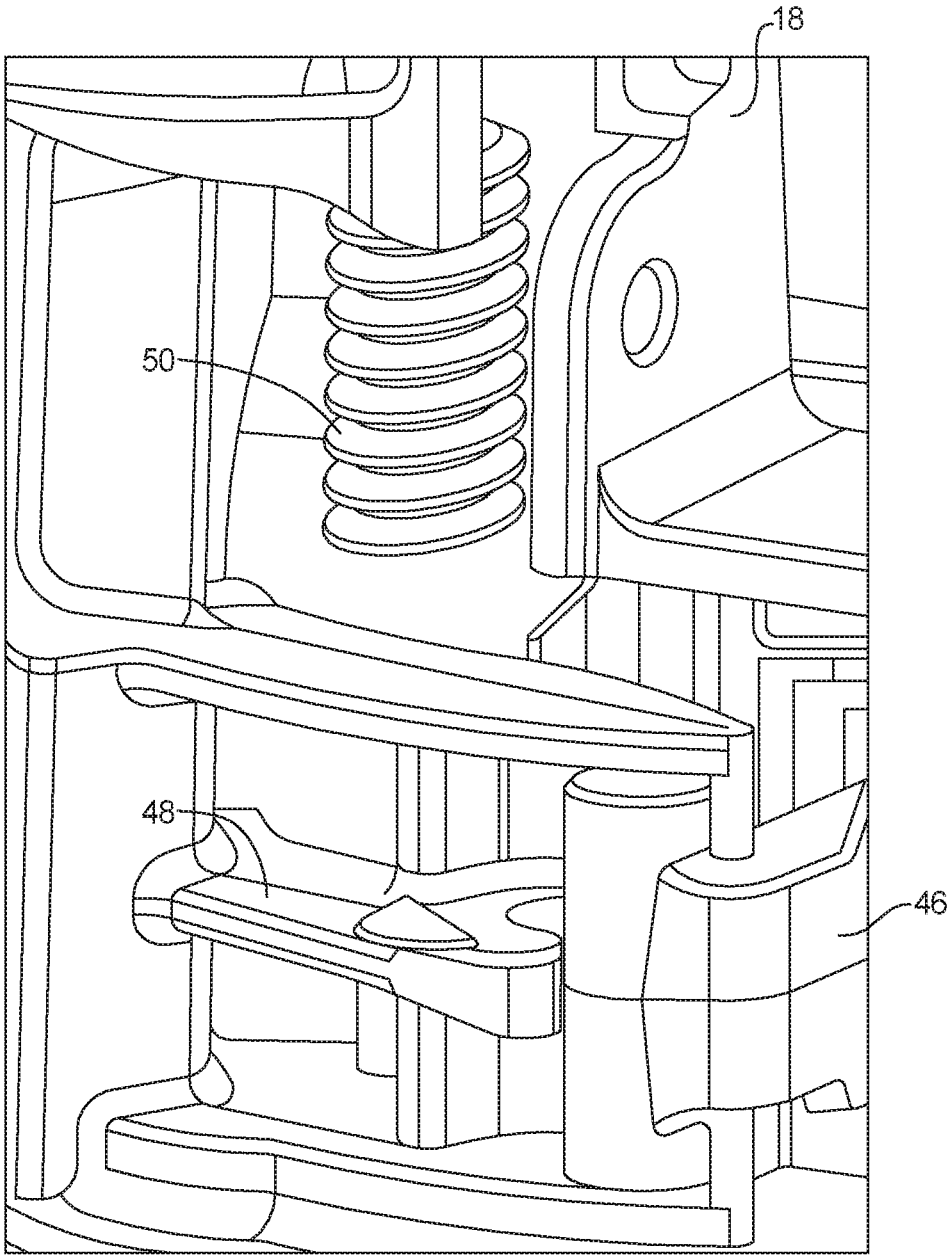
FIG. 4 is an inner side perspective view of a portion of a bracket of the door handle assembly.

A leg 46 extends out from the inner side 28 of the handle 16 at the rearward portion 22B. As best seen in FIG. 4, the leg 46 is engaged with a counterbalance 48 connected to the bracket 18 and a counterbalance spring 50. The counterbalance spring 50 exerts a force on the leg 46, and thus the handle 16, inwardly to bias the handle 16 to the closed position.

With reference to FIGS. 1 and 3, the handle 16 and the end cap 14 are separated by a gap 52 when the handle 16 is in the closed position. The gap 52 is defined as a distance from an edge 54 of the rearward portion 22B of the handle 16 to a forward edge 56 of the end cap 14.

The bracket 18 supports the various components of the door handle assembly 10, as noted above, and generally includes an outer side 58 to which the end cap 14 and handle 16 are attached and an inner side 60 that is connected to a door frame or other structural member of the door (not shown).

Figure 5:
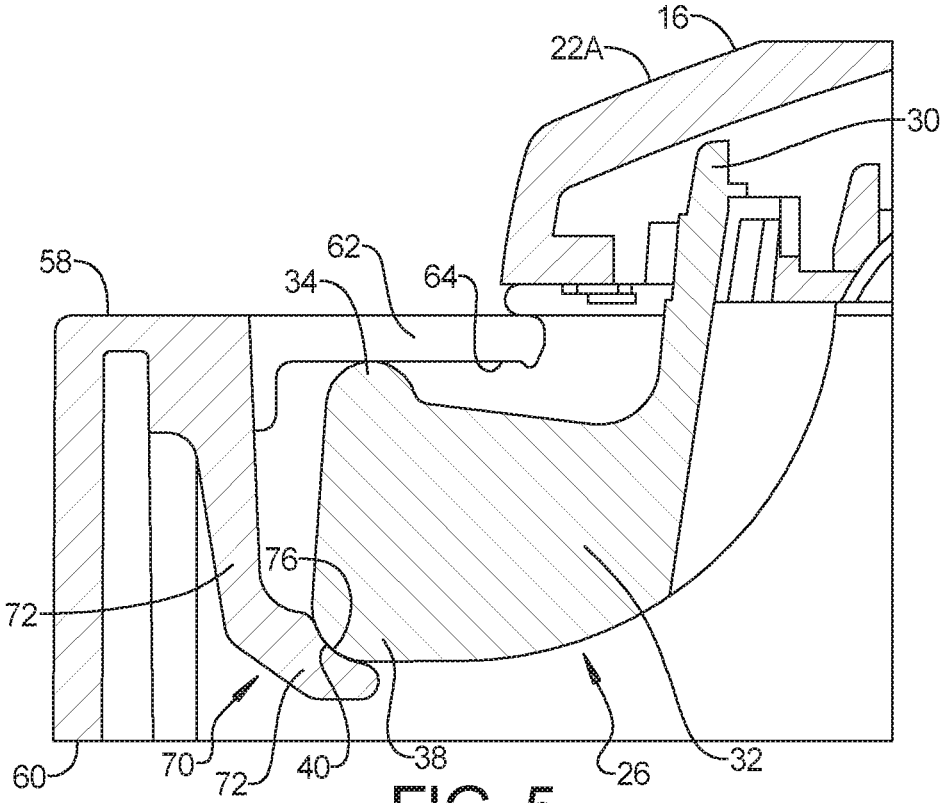
FIG. 5 is an enlarged side cross-sectional view of a portion of the door handle assembly in the closed position.
Figure 6:
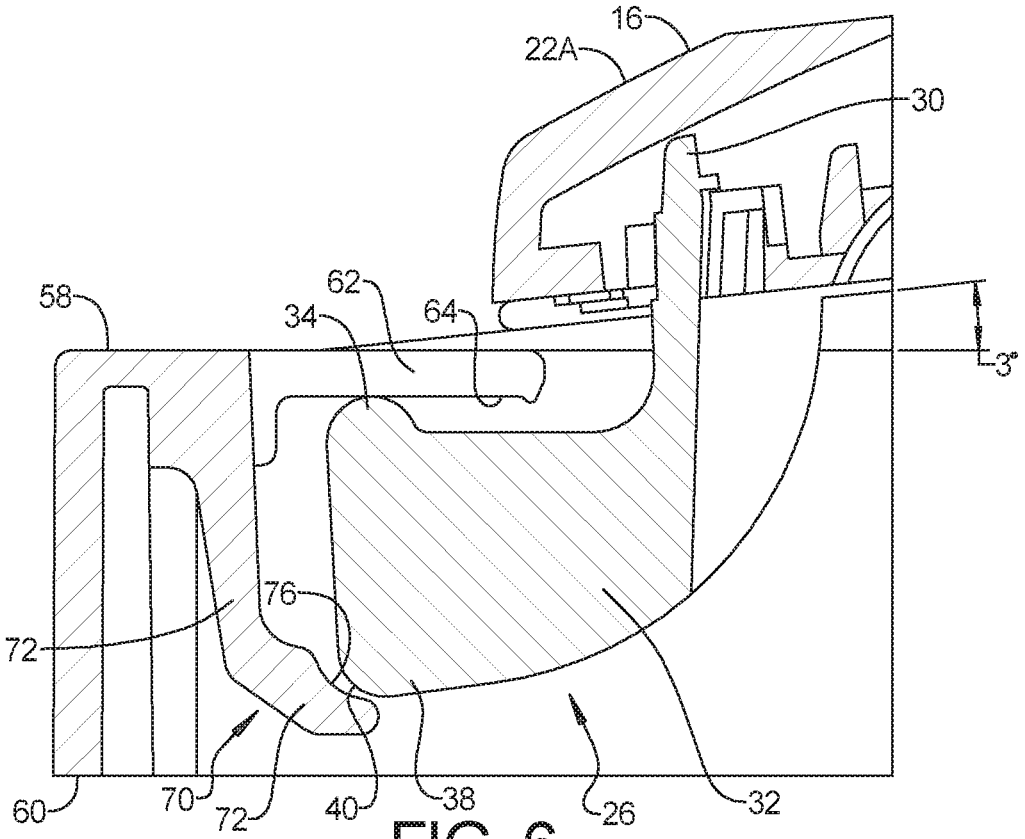
FIG. 6 is an enlarged side cross-sectional view of a portion of the door handle assembly moving to the open position.

Turning to FIGS. 5 and 6, the bracket 18 includes a window 62 that extends from the outer side 58 of the bracket 18 to the inner side 60. The pivot arm 30 of the handle 16 is disposed through the window 62. The pivot point 34 contacts a bearing surface 64 within the window 62. Thus, the pivot point 34 rides on and pivots about the bearing surface 64 when the handle 16 is moved between the closed position and the open position.

A retention feature 70 is disposed on the inner side 60 of the bracket 18. The retention feature 70 maintains a consistent gap 52 between the handle 16 and the end cap 14 when the handle 16 is in the closed position by engaging the lower portion 38 of the pivot arm 30. The retention feature 70 is preferably formed integrally with the bracket 18, though the retention feature 70 may be a separate component without departing from the scope of the present disclosure. The retention feature 70 is semi-flexible in a forward direction and the rearward direction.

The retention feature 70 is disposed adjacent the window 62. The retention feature 70 includes a lever 72 extending inwardly from the bracket 18. The lever 72 includes a bent portion 74 that extends toward the pivot arm 30 in a rearward direction. The retention feature 70 includes a curved engagement surface 76 on the bent portion 74 that engages the curved contact surface 40 on the lower portion 38 of the pivot arm 30. In one aspect, the engagement surface 76 has a shape that substantially matches or substantially mates with the contact surface 40.

With reference to FIG. 5, when the handle 16 is in the closed position, the counterbalance spring 50 exerts a force on the handle 16 inwardly and the lower portion 38 of the pivot arm 30 pivots about the pivot point 34 and engages the retention feature 70. However, the semi-flexible nature of the retention feature 70 exerts a force on the lower portion 38 of the lever arm 30 in the rearward direction. Thus, the position of the handle 16 is maintained between these two forces and the gap 52 distance is maintained. To prevent the retention feature 70 from opening the handle 16, the force exerted by the counterbalance spring 50 is greater than the force exerted by the retention feature 70. With reference to FIG. 6, when the handle 16 is moved to the opened position by an operator, the lower portion 38 pivots away from the retention feature 70 and at approximately 3 degrees of rotation the retention feature 70 ceases to exert any force on the pivot arm 30.

The door handle assembly 10 of the present disclosure offers several advantages. These include maintaining the gap 52 at a consistent distance when the handle 16 is closed to improve the aesthetics of the vehicle, prevention of the handle 16 sticking due to the semi-flexible nature of the retention feature 70, minimizing the size of the gap 52 by keeping the gap 52 consistent, minimizing the addition of complex parts, and minimizing the effect on the "feel" of the operation of the handle 16, to name but a few.

The terms "forward", "rearward", "inner", "inwardly", "outer", and "outwardly" are terms used relative to the orientation of the door handle assembly 10 as shown in the drawings of the present application relative to a motor vehicle. Thus, "forward" refers to a direction toward a front of a motor vehicle, "rearward" refers to a direction toward a rear of a motor vehicle, "inner" and "inwardly" refers to a direction towards the interior of a motor vehicle, and "outer" and "outwardly" refers to a direction towards the exterior of a motor vehicle. Thus, while the orientation of the door handle assembly 10 may change with respect to a given use (driver's side door vs. passenger door, etc.), these terms are intended to still apply relative to the orientation of the components of the door handle assembly 10 as shown in the drawings.

The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. A door handle assembly comprising:

a bracket having a retention feature;

an end cap connected to the bracket; and a handle pivotally connected to the bracket and moveable between a closed position and an open position, the handle having a pivot arm disposed within the bracket, the pivot arm having a pivot point and a lower portion, wherein the pivot arm engages the bracket and the lower portion is disposed on a side of the pivot point opposite the handle, wherein the handle includes a forward portion and a rearward portion, and the pivot arm is disposed at the forward portion of the handle, wherein the end cap is disposed adjacent the rearward portion of the handle, and wherein the rearward portion of the handle is connected to the bracket by a leg;

a spring connected to the leg, wherein the spring biases the handle to the closed position, wherein the retention feature engages the lower portion when the handle is in the closed position and applies a force separate from the spring on the pivot arm in a rearward direction to maintain a gap distance between the handle and the end cap.

2. The door handle assembly of claim 1 wherein the retention feature is semi-flexible in a forward direction and the rearward direction.

3. The door handle assembly of claim 1 wherein the retention feature includes a lever extending into the bracket, the lever having a bent portion that extends toward the pivot arm.

4. The door handle assembly of claim 3 wherein the retention feature includes a curved surface on the lever that engages a matching curved surface on the lower portion of the pivot arm.

5. The door handle assembly of claim 1 wherein the retention feature does not engage the pivot arm when the pivot arm has rotated approximately 3 degrees from the closed position.

6. The door handle assembly of claim 1 wherein the bias of the spring exerts a force on the handle greater than the force on the pivot arm applied by the retention feature to keep the handle in the closed position when not moved to the open position by an operator of the door handle assembly.

7. The door handle assembly of claim 1 wherein the retention feature is integrally molded with the bracket.

8. The door handle assembly of claim 1 wherein the bracket defines a window through which the pivot arm of the handle is extended, and the retention feature is disposed adjacent the window.

9. The door handle assembly of claim 8 wherein the bracket includes an outer side on which the handle is disposed and an inner side through which the pivot arm of the handle extends.

10. A door handle assembly for a door of a motor vehicle, the door handle assembly comprising:

a bracket connected to the door and having a retention feature, the retention feature having a lever extending from the bracket, the lever semi-flexible in a forward direction and a rearward direction, the lever having an engagement surface at an end thereof;

an end cap connected to the bracket;

a spring; and a handle pivotally connected to the bracket and moveable between a closed position and an open position, the handle having a pivot arm disposed within the bracket, the pivot arm having a pivot point and a lower portion, wherein the pivot arm engages the bracket and the lower portion is disposed on a side of the pivot point opposite the handle, and the lower portion has a contact surface matching a shape of the engagement surface of the lever, wherein the engagement surface of the lever engages the contact surface of the lower portion when the handle is in the closed position and applies a force separate from the spring on the pivot arm in the rearward direction to maintain a gap distance between the handle and the end cap, and wherein the spring biases the handle to the closed position and the bias of the spring exerts a force on the handle greater than the force on the pivot arm applied by the retention feature to keep the handle in the closed position when not moved to the open position by an operator of the door handle assembly.

11. The door handle assembly of claim 10 wherein the engagement surface of the lever does not engage the contact surface of the lower portion when the handle is in the open position.

12. The door handle assembly of claim 10 wherein the bracket includes an inner side connected to the door and an outer side, the handle disposed on the outer side of the bracket, the pivot arm extending through a window in the bracket and the lever engaging the pivot arm on the inner side of the bracket.

13. The door handle assembly of claim 10 wherein the handle includes a forward portion and a rearward portion, and the pivot arm is disposed at the forward portion of the handle, and the end cap is disposed adjacent the rearward portion of the handle.

* * * * *